US011407225B2

(12) United States Patent
Lan et al.

(10) Patent No.: US 11,407,225 B2
(45) Date of Patent: Aug. 9, 2022

(54) INKJET CHIP AND THERMAL BUBBLE INKJET PRINTHEAD USING THE SAME

(71) Applicant: International United Technology Co., Ltd., Hsin-Chu (TW)

(72) Inventors: Yuan-Liang Lan, Hsinchu County (TW); Chih-Shun Chuang, Hsinchu (TW); Chao-Cheng Lan, Hsinchu (TW)

(73) Assignee: International United Technology Co., Ltd., Hsin-Chu (TW)

( * ) Notice: Subject to any disclaimer, the term of this patent is extended or adjusted under 35 U.S.C. 154(b) by 0 days.

(21) Appl. No.: 17/152,816

(22) Filed: Jan. 20, 2021

(65) Prior Publication Data

US 2021/0221132 A1 Jul. 22, 2021

Related U.S. Application Data

(60) Provisional application No. 62/963,555, filed on Jan. 21, 2020.

(51) Int. Cl.
*B41J 2/14* (2006.01)

(52) U.S. Cl.
CPC ..... *B41J 2/14129* (2013.01); *B41J 2/14088* (2013.01); *B41J 2/14112* (2013.01); (Continued)

(58) Field of Classification Search
CPC ..... B41J 2/14129; B41J 2/14088; B41J 2/14112; B41J 2/14072; B41J 2/1433; B41J 2202/13
See application file for complete search history.

(56) References Cited

U.S. PATENT DOCUMENTS 6,536,877 B2 * 3/2003 Miyamoto ..... B41J 2/1631 347/58
6,758,552 B1 * 7/2004 Figueredo ..... B41J 2/1603 257/E27.035

(Continued)

FOREIGN PATENT DOCUMENTS

| | | |
|---|---|---|
| CN | 1600548 | 3/2005 |
| CN | 1724257 | 1/2006 |
| CN | 101229715 | 7/2008 |

OTHER PUBLICATIONS

"Office Action of China Counterpart Application", dated Apr. 21, 2022, p. 1-p. 5.

*Primary Examiner* — Geoffrey S Mruk
(74) *Attorney, Agent, or Firm* — JCIPRNET

(57) ABSTRACT

An inkjet chip including a substrate, a plurality of control elements, an insulating layer, a plurality of first conductive patterns, a plurality of second conductive patterns and a plurality of heaters is provided. The insulating layer is disposed on the control element and has a plurality of openings. The openings each have a first length in a first direction. Each first conductive pattern has a first sidewall overlapping one of the openings and is electrically connected between one of the control elements and one of the heaters. Each second conductive pattern has a second sidewall overlapping the one of the openings and is electrically connected to one of the heaters. A distance in the first direction is included between the first sidewall and the second sidewall opposing to each other. The distance is less than the first length. A thermal bubble inkjet printhead adopting the inkjet chip is also provided.

20 Claims, 7 Drawing Sheets

(52) U.S. Cl.
CPC ..... *B41J 2/1433* (2013.01); *B41J 2/14072* (2013.01); *B41J 2202/13* (2013.01)

(56) References Cited

U.S. PATENT DOCUMENTS

| | | | | |
|---|---|---|---|---|
| 7,267,430 | B2 * | 9/2007 | Parish | B41J 2/14072 347/59 |
| 2002/0067391 | A1 | 6/2002 | Anagnostopoulos et al. | |
| 2007/0153064 | A1 * | 7/2007 | Miyamoto | B41J 2/14129 347/58 |

* cited by examiner

INKJET CHIP AND THERMAL BUBBLE INKJET PRINTHEAD USING THE SAME

CROSS-REFERENCE TO RELATED APPLICATION

This application claims the priority benefit of U.S. provisional application Ser. No. 62/963,555, filed on Jan. 21, 2020. The entirety of the above-mentioned patent application is hereby incorporated by reference herein and made a part of this specification.

BACKGROUND

Technical Field

The disclosure relates to inkjet printing device, and in particular, to an inkjet chip and a thermal bubble inkjet printhead.

Description of Related Art

Inkjet printing technique has been broadly applied to printing equipment. According to the inkjet printing technique, droplets of ink is jetted onto a print medium to form ink dots on the print medium, such that an image or text is formed on the print medium by these ink dots. The most popular inkjet printing techniques include piezoelectric inkjet printing and thermal bubble inkjet printing. According to thermal bubble inkjet printing, ink is vaporized instantaneously by heaters in the inkjet printhead for producing high-pressure bubbles, and the ink is then ejected through nozzles to form droplets of ink.

In order to vaporize the ink, the instantaneous temperature of the inkjet printhead is extremely high (for example, the ink mostly composed by aqueous liquid may be heated to nearly 300° C.). Repeated heating and cooling processes will produce thermal effects being unfavorable to the structure of inkjet chip and result in a deterioration of reliability of the inkjet printhead. Generally, for example, the heater is electrically connected to a driving element via a contact hole of an insulating layer. Since the driving current is transmitted to the heater through the contact hole, excess and unnecessary heat will be generated near the contact hole and then causes the instability of connection between the heater and the driving element. Therefore, an appropriate structure of inkjet chip to inhibit the generation of excess heat (or ineffective heat) and improve the reliability of the inkjet printhead is still desired.

SUMMARY

The disclosure provides an inkjet chip with better current conduction efficiency.

The disclosure provides a thermal bubble inkjet printhead with better reliability.

The thermal bubble inkjet printhead of the disclosure includes: a substrate, a plurality of control elements, an insulating layer, a plurality of first conductive patterns, a plurality of second conductive patterns, a plurality of heaters, an ink barrier and a nozzle plate. The control elements are disposed on the substrate. The insulating layer is disposed on the control element and has a plurality of openings. The openings each have a first length in a first direction. The first conductive patterns and the second conductive patterns are separated from each other. The first conductive patterns each have a first sidewall overlapping one of the openings.

The second conductive patterns each have a second sidewall overlapping the one of the openings. A distance in the first direction is included between the first sidewall and the second sidewall opposing to each other. The distance is less than the first length. The heaters are electrically connected to the first conductive patterns and the second conductive patterns. Each first conductive pattern is electrically connected between one of the control elements and one of the heaters. The ink barrier is disposed on the heater and has a plurality of ink chambers. Each of the ink chambers overlaps one of the heaters. The nozzle plate is disposed on the ink barrier and has a plurality of nozzles. Each nozzle overlaps one of the ink chambers.

In the thermal bubble inkjet printhead according to an embodiment of the disclosure, each of the first conductive patterns further has a first surface connecting the first sidewall. Each of the second conductive patterns further has a second surface connecting the second sidewall. The heaters directly cover the first sidewalls, the first surfaces, the second sidewalls and the second surfaces.

In the thermal bubble inkjet printhead according to an embodiment of the disclosure, each of the openings of the insulating layer has a second length in a second direction perpendicular to the first direction. A width of each of the first conductive patterns and the second conductive patterns in the second direction is greater than the second length of the openings.

In the thermal bubble inkjet printhead according to an embodiment of the disclosure, the control elements are thin film transistors.

In the thermal bubble inkjet printhead according to an embodiment of the disclosure, the composition of the heaters includes a transparent conductive material.

In the thermal bubble inkjet printhead according to an embodiment of the disclosure, further comprises: a passivation layer. The passivation layer covers the heaters. The ink chambers of the ink barrier expose a part of a surface of the passivation layer. The material of the passivation layer includes silicon nitride, silicon carbide, tantalum, or a combination thereof.

In the thermal bubble inkjet printhead according to an embodiment of the disclosure, each of the control elements includes a semiconductor pattern, a gate electrode, a source electrode and a drain electrode. The semiconductor pattern has a channel region, a source region and a drain region. The source region and the drain region are disposed on two opposite sides of the channel region. The gate electrode overlaps the channel region of the semiconductor pattern. The source electrode and the drain electrode are electrically connected to the source region and the drain region of the semiconductor pattern, respectively. The gate electrode belongs to a first metal conductive layer. The source electrode, the drain electrode, the first conductive patterns and the second conductive patterns belong to a second metal conductive layer. An interlayer dielectric layer is provided between the first metal conductive layer and the second metal conductive layer. The heaters directly cover the interlayer dielectric layer, a part of a surface of the first conductive patterns and a part of a surface of the second conductive patterns.

In the thermal bubble inkjet printhead according to an embodiment of the disclosure, each of the heaters includes a heating portion, a first end portion and a second end portion. The heating portion completely overlaps one of the openings of the insulating layer. The first end portion and the second end portion are located on two opposite sides of the heating portion. The first end portion and the second end portion connect the heating portion and each partially overlap the one opening of the insulating layer. The heating portion has a first width in a second direction perpendicular to the first direction. The first end portion and the second end portion each have a second width in the second direction. The second width is greater than the first width.

In the thermal bubble inkjet printhead according to an embodiment of the disclosure, each of the heaters includes a third sidewall, a fourth sidewall, a first surface and a second surface. The third sidewall and the fourth sidewall opposite to each other. The first surface connects the third sidewall. The second surface connecting the fourth sidewall. The third sidewall and the first surface are covered with one of the first conductive patterns. The fourth sidewall and the second surface are covered with one of the second conductive patterns.

In the thermal bubble inkjet printhead according to an embodiment of the disclosure, each of the openings of the insulating layer has a second length in a second direction perpendicular to the first direction. A width in the second direction of each heater is greater than the second length of each opening.

The inkjet chip of the disclosure includes: a substrate, a plurality of control elements, an insulating layer, a plurality of first conductive patterns, a plurality of second conductive patterns and a plurality of heaters. The control elements are disposed on the substrate. The insulating layer is disposed on the control element and has a plurality of openings. The openings each have a first length in a first direction. The first conductive patterns and the second conductive patterns are separated from each other. The first conductive patterns each have a first sidewall overlapping one of the openings. The second conductive patterns each have a second sidewall overlapping the one of the openings. A distance in the first direction is included between the first sidewall and the second sidewall opposing to each other. The distance is less than the first length. The heaters are electrically connected to the first conductive patterns and the second conductive patterns. Each first conductive pattern is electrically connected between one of the control elements and one of the heaters.

In the inkjet chip according to an embodiment of the disclosure, each of the first conductive patterns further has a first surface connecting the first sidewall. Each of the second conductive patterns further has a second surface connecting the second sidewall. The heaters directly cover the first sidewalls, the first surfaces, the second sidewalls and the second surfaces.

In the inkjet chip according to an embodiment of the disclosure, each of the openings of the insulating layer has a second length in a second direction perpendicular to the first direction. A width of each of the first conductive patterns and the second conductive patterns in the second direction is greater than the second length of the openings.

In the inkjet chip according to an embodiment of the disclosure, the control elements are thin film transistors.

In the inkjet chip according to an embodiment of the disclosure, the composition of the heaters includes a transparent conductive material.

In the inkjet chip according to an embodiment of the disclosure, further comprises: a passivation layer. The passivation layer covers the heaters. The ink chambers of the ink barrier expose a part of a surface of the passivation layer. The material of the passivation layer includes silicon nitride, silicon carbide, tantalum, or a combination thereof.

In the inkjet chip according to an embodiment of the disclosure, each of the control elements includes a semiconductor pattern, a gate electrode, a source electrode and a drain electrode. The semiconductor pattern has a channel region, a source region and a drain region. The source region and the drain region are disposed on two opposite sides of the channel region. The gate electrode overlaps the channel region of the semiconductor pattern. The source electrode and the drain electrode are electrically connected to the source region and the drain region of the semiconductor pattern, respectively. The gate electrode belongs to a first metal conductive layer. The source electrode, the drain electrode, the first conductive patterns and the second conductive patterns belong to a second metal conductive layer. An interlayer dielectric layer is provided between the first metal conductive layer and the second metal conductive layer. The heaters directly cover the interlayer dielectric layer, a part of a surface of the first conductive patterns and a part of a surface of the second conductive patterns.

In the inkjet chip according to an embodiment of the disclosure, each of the heaters includes a heating portion, a first end portion and a second end portion. The heating portion completely overlaps one of the openings of the insulating layer. The first end portion and the second end portion are located on two opposite sides of the heating portion. The first end portion and the second end portion connect the heating portion and each partially overlap the one opening of the insulating layer. The heating portion has a first width in a second direction perpendicular to the first direction. The first end portion and the second end portion each have a second width in the second direction. The second width is greater than the first width.

In the inkjet chip according to an embodiment of the disclosure, each of the heaters includes a third sidewall, a fourth sidewall, a first surface and a second surface. The third sidewall and the fourth sidewall opposite to each other. The first surface connects the third sidewall. The second surface connecting the fourth sidewall. The third sidewall and the first surface are covered with one of the first conductive patterns. The fourth sidewall and the second surface are covered with one of the second conductive patterns.

In the inkjet chip according to an embodiment of the disclosure, each of the openings of the insulating layer has a second length in a second direction perpendicular to the first direction. A width in the second direction of each heater is greater than the second length of each opening.

Based on the above, in the inkjet chip and the thermal bubble inkjet printhead according to an embodiment of the disclosure, a sidewall and a surface connected to the sidewall of the heater or the conductive pattern are exposed by an opening of the insulating layer. An electrical connection between the heater and the conductive pattern is carried out through directly covering the sidewall and the surface of one of the heater and the conductive pattern with the other of the heater and the conductive pattern. Accordingly, the current conduction efficiency can be enhanced. Besides, the generation of excess heat can be effectively inhibited so as to improve the reliability of the thermal bubble inkjet printhead.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1:
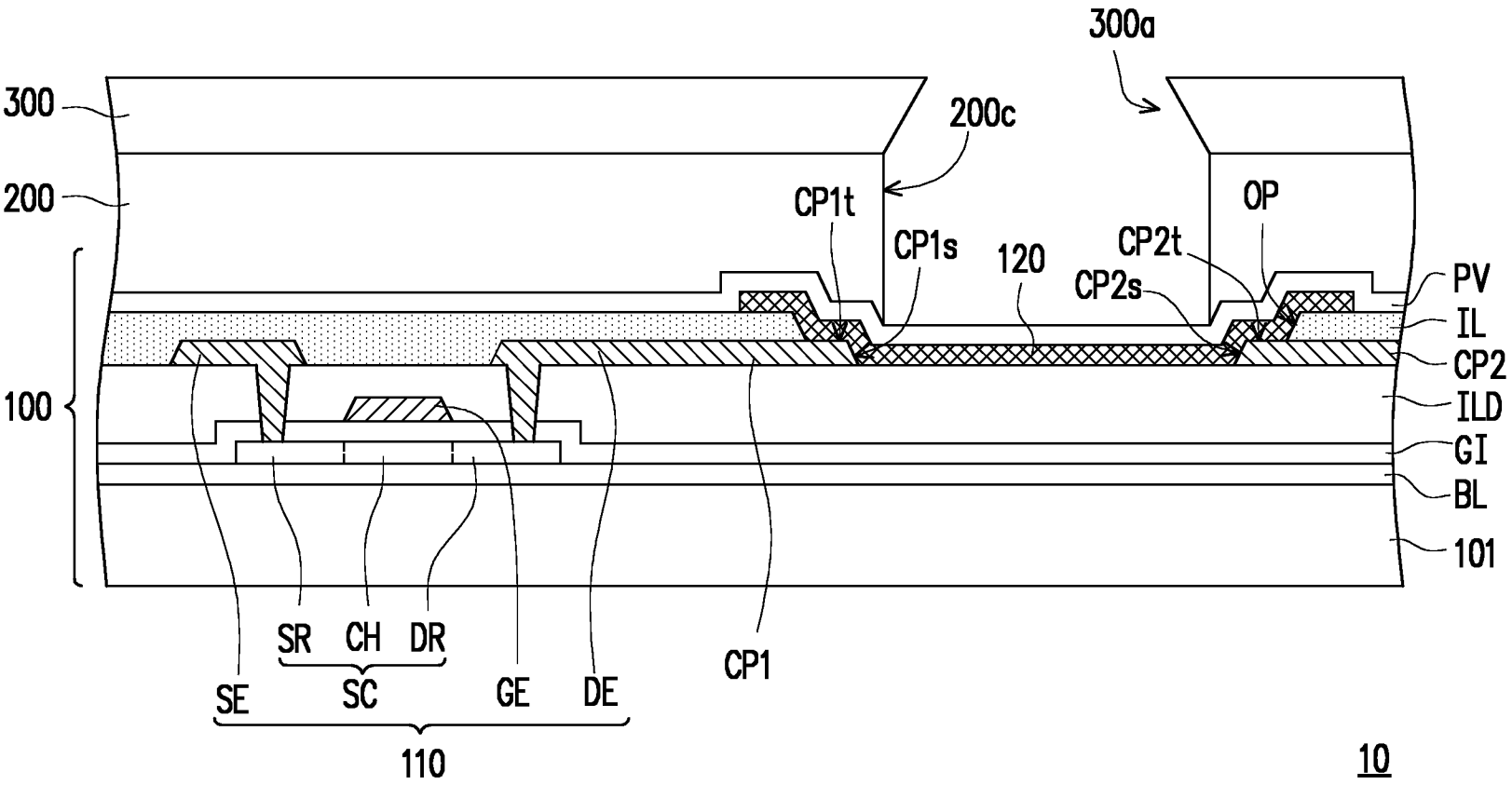
FIG. 1 is a schematic cross-sectional view of a thermal bubble inkjet printhead according to a first embodiment of the invention.
Figure 2A:
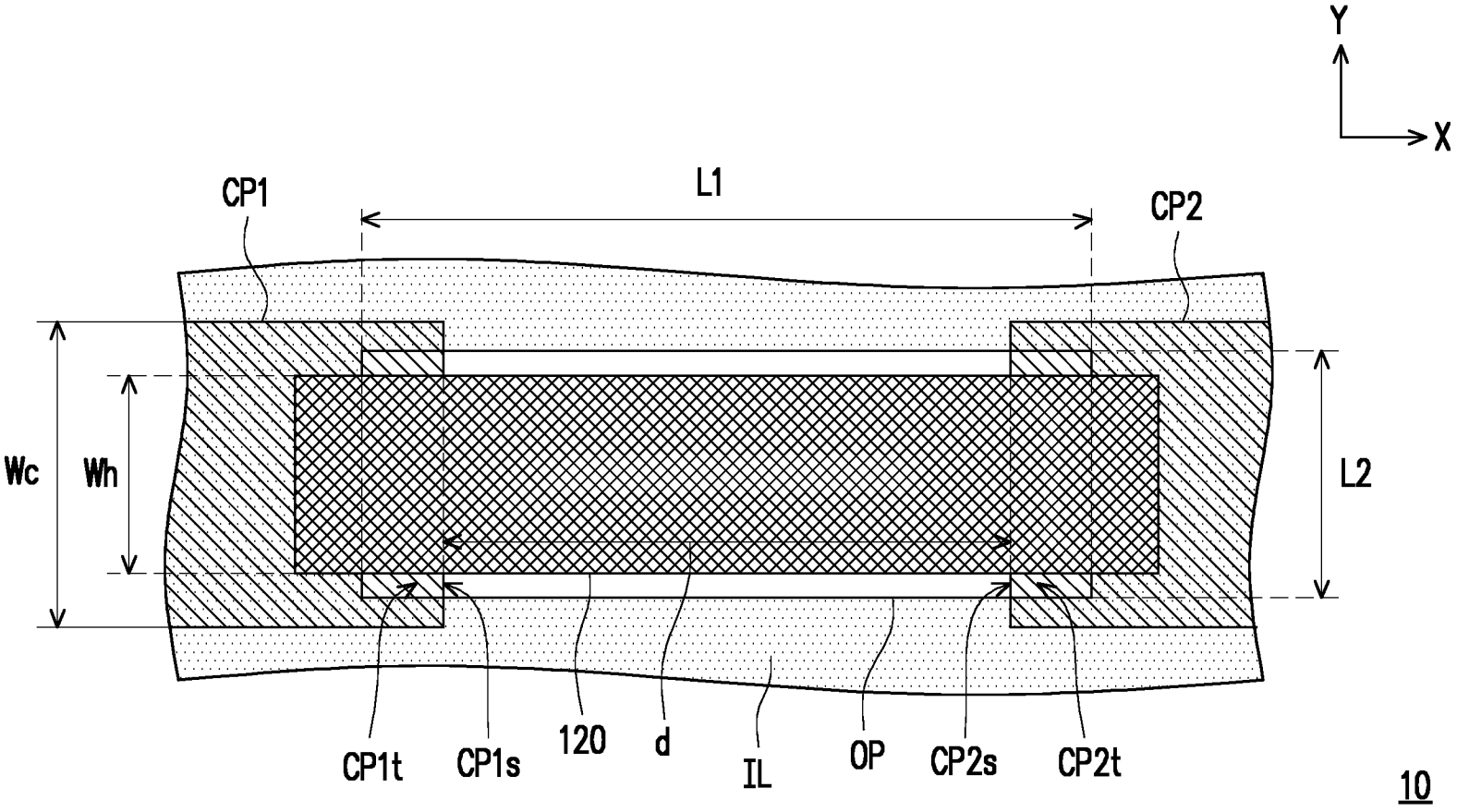
FIG. 2A is a schematic top-view of a thermal bubble inkjet printhead of FIG. 1.
Figure 2B:
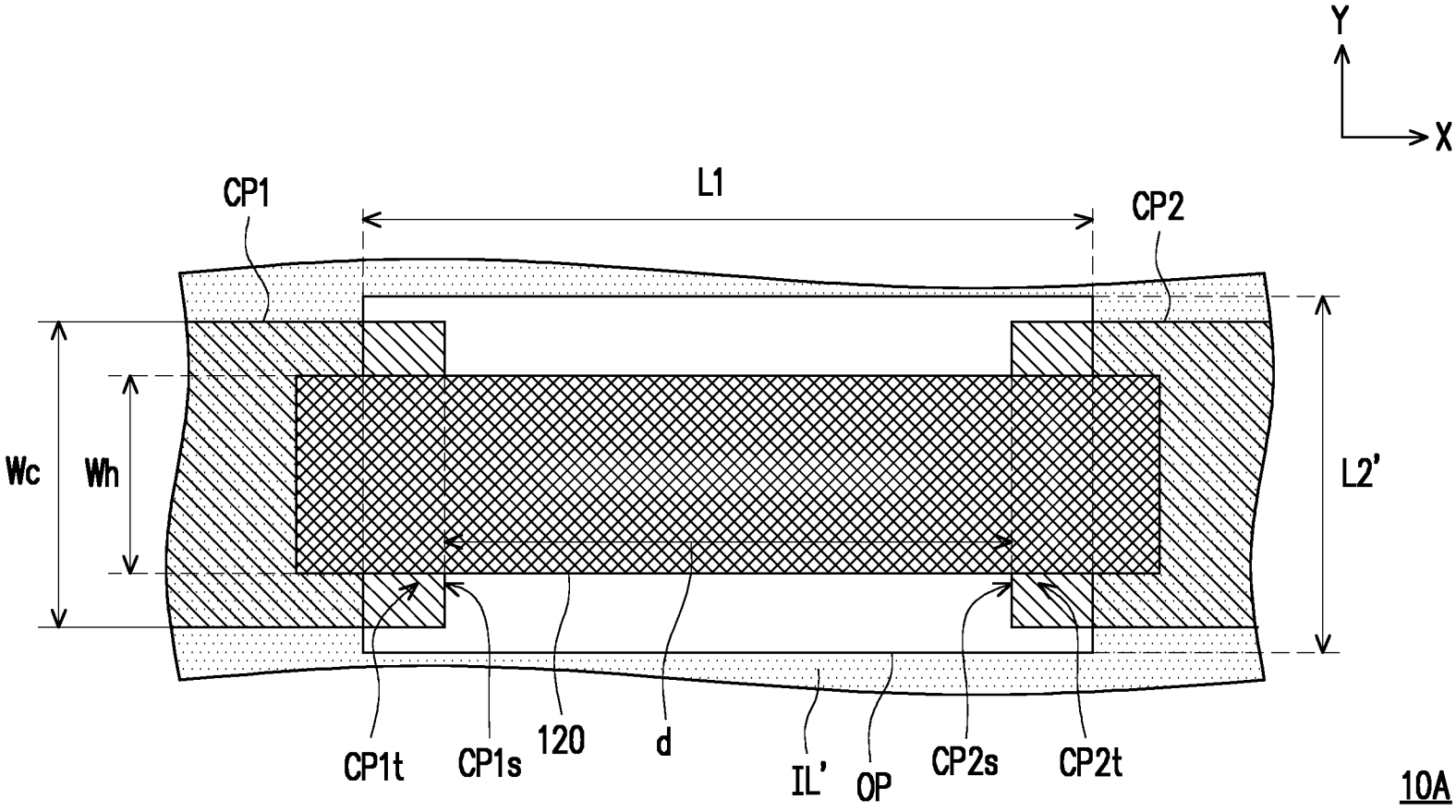
FIG. 2B is a schematic top-view of a thermal bubble inkjet printhead according to another embodiment of the invention.

FIG. 1 is a schematic cross-sectional view of a thermal bubble inkjet printhead according to a first embodiment of the invention. FIG. 2A is a schematic top-view of a thermal bubble inkjet printhead of FIG. 1. FIG. 2B is a schematic top-view of a thermal bubble inkjet printhead according to another embodiment of the invention.

Referring to FIG. 1 and FIG. 2A, the thermal bubble inkjet printhead 10 comprises an inkjet chip 100, an ink barrier 200 and a nozzle plate 300. The ink barrier 200 is disposed between the inkjet chip 100 and the nozzle plate 300. The inkjet chip 100 includes a substrate 101, a plurality of control elements 110 and a plurality of heaters 120. These control elements 110 are distributed on the substrate 101. The heaters 120 are respectively electrically connected to the control elements 110. The on/off state of each heater 120 can be switched by one of the control elements 110.

It is worth noting that since the substrate 101 of present embodiment is a glass substrate, the size of inkjet chip 100 can be equal to or greater than 4 inch. That means, the size of the inkjet chip 100 is not limited to the size of conventional silicon substrate/wafer, so that the thermal bubble inkjet printhead 10 can merely contain one inkjet chip 100. In other words, there is no need to splice multiple inkjet chips with smaller size into the thermal bubble inkjet printhead 10 so that the quality of printed image can be effectively improved. However, the invention is not limited thereto. In other embodiments, the material of the substrate 101 may also include quartz, polyimide (PI), polycarbonate (PC), polyethylene terephthalate (PET), or another suitable polymer material.

In the present embodiment, for example, the control element 110 may be a thin film transistor (TFT), for example, a low temperature polysilicon (LTPS) TFT, but the invention is not limited thereto. In other embodiments, the control element 110 may also be an amorphous silicon (a-Si) TFT, a microcrystalline silicon (micro-Si) TFT or a metal oxide transistor. In the present embodiment, the method of forming the control element 110 may include the following steps: a semiconductor pattern SC, a gate insulator GI, a gate electrode GE, an interlayer dielectric layer ILD, a source electrode SE and a drain electrode DE are sequentially formed on the substrate 101.

The gate electrodes GE of the control elements 110 may belong to a first metal conductive layer, and the source electrodes SE and the drain electrodes DE of the control elements 110 may belong to a second metal conductive layer. Generally, the gate electrode GE, the source electrode SE and the drain electrode DE are formed by using metal material (for example, Al, Mo, Au, Cu, Ta, a combination thereof, or an alloy thereof) basing on the consideration of conductivity.

The semiconductor pattern SC has a source region SR, a drain region DR and a channel region CH. The source region SR and the drain region DR are located on two opposite sides of the channel region CH. The source electrode SE and the drain electrode DE penetrate the interlayer dielectric layer ILD and the gate insulator GI to electrically connect the source region SR and the drain region DR of the semiconductor pattern SC, respectively. For example, the gate electrode GE of the control element 110 can be selectively arranged above the semiconductor pattern SC to form a top-gate TFT, but the invention is not limited thereto. In other embodiments, the gate electrode GE of the control element may also be arranged below the semiconductor pattern SC to form a bottom-gate TFT. In the present embodiment, the material of the semiconductor pattern SC is, for example, a polysilicon semiconductor material, but the invention is not limited thereto.

In addition, the inkjet chip 100 further includes a buffer layer BL disposed between the substrate 101 and the semiconductor pattern SC (or gate insulator GI). It should be noted that the gate insulator GI, the buffer layer BL and the interlayer dielectric layer ILD can be fulfilled by any method well-known in the art to form any gate insulator, any buffer layer and any interlayer dielectric layer used in a display panel. Therefore, information (for example, formation method and composition) about the buffer layer BL, the gate insulator GI and the interlayer dielectric layer ILD will not be described in detail here. For example, the composition of buffer layer BL, interlayer dielectric layer ILD and the gate insulator GI may include SiN, $SiO_2$ or $SiO_xO_y$, but the invention is not limited thereto.

In the present embodiment, the inkjet chip 100 may further comprises an insulating layer IL, a plurality of first conductive patterns CP1 and a plurality of second conductive patterns CP2. The first conductive patterns CP1 and the second conductive patterns CP2 are separated from each other. The first conductive patterns CP1, the second conductive patterns CP2, the source electrodes SE and the drain electrodes belong to the same film layer, for example, the second metal conductive layer, but the invention is not limited thereto. The insulating layer IL is disposed on the control element 110 and has a plurality of openings OP overlapping the heaters 120. In the present embodiment, for example, the source electrodes SE and the second conductive patterns CP2 may be electrically connected to an outer power source to receive driving currents, but the invention is not limited thereto. It should be noted that the insulating layer IL can be fulfilled by any method well-known in the art to form any insulating layer used in a display panel. Therefore, information (for example, formation method and composition) about the insulating layer IL will not be described in detail here.

Further, each of the first conductive patterns CP1 has a first sidewall CP1*s* overlapping one of the openings. Each of the second conductive patterns CP2 has a second sidewall CP2*s* overlapping one of the openings. In other words, the first sidewalls CP1*s* of the first conductive patterns CP1 and the second sidewalls CP2*s* of the second conductive patterns CP2 are exposed by the openings OP of the insulating layer IL, but the invention is not limited thereto. In the present embodiment, each of the first conductive patterns CP1 further has a first surface CP1*t* connecting the first sidewall CP1*s*, and each of the second conductive patterns CP2 further has a second surface CP2*t* connecting the second sidewall CP2*s*. The first surfaces CP1*t* and the second surfaces CP2*t* are exposed by the openings OP of the insulating layer IL as well.

From another point of view, the openings OP each have a first length L1 in a direction X. A distance d in the direction X is included between the first sidewall CP1*s* and the second sidewall CP2*s* opposing to each other and the distance d is less than the first length L1 of each opening OP. It should be noted that an electrical connection between the heater 120 and the first conductive pattern CP1 is carried out through directly covering the first sidewall CP1*s* and the first surface CPR with one end portion of the heater 120. Similarly, an electrical connection between the heater 120 and the second conductive pattern CP2 is carried out through directly covering the second sidewall CP2*s* and the second surface CP2*t* with another end portion of the heater 120. So that, the current is mostly transmitted from the conductive pattern to the heater 120 (or transmitted from the heater 120 to the conductive pattern) through the sidewall of the conductive pattern exposed by the opening OP of the insulating layer IL. Accordingly, the current conduction efficiency can be enhanced and the generation of excess heat can be effectively inhibited so as to improve the reliability of the thermal bubble inkjet printhead 10. It is worth mentioning that the area between the first conductive pattern CP1 and the second conductive pattern CP2 may define the heating zone of the inkjet chip 100.

However, the invention is not limited thereto. In other embodiments, an electrical connection between the heater and the conductive pattern may be carried out through directly covering the sidewall of the conductive pattern only. In other words, the heater is electrically connected to the conductive pattern without direct contact with the top surface connected to the sidewall of the conductive pattern.

On the other hand, the openings OP each further have a second length L2 in a direction Y perpendicular to the direction X. A width We of each of the first conductive patterns CP1 and the second conductive patterns CP2 in the direction Y is greater than the second length L2 of each opening OP so as to avoid the driving current being transmitted from the conductive pattern to heater (or from the heater to the conductive pattern) through the sidewalls of the conductive pattern extending in the direction X (as illustrated in FIG. 2A). Accordingly, excess heat generated near the corners of the conductive pattern can be effectively inhibited so that the reliability of the thermal bubble inkjet printhead 10 can be improved. In the present embodiment, the heater 120 may have a width Wh in the direction Y, and the width Wh is less than the second length L2 of each opening OP, but the invention is not limited thereto. In other embodiments, the width of the heater in the direction Y may also be greater than the second length L2 of each opening OP. However, the invention is not limited thereto. In other embodiment, the width We of each of the first conductive patterns CP1 and the second conductive patterns CP2 of the thermal bubble inkjet printhead 10A may be less than the second length L2' of each opening OP of the insulating layer IL' (as illustrated in FIG. 2B).

It is worth mentioning that the material of the heaters 120 is a transparent conductive material, such that the reliability of the inkjet chip 100 can be improved and the cost of thermal bubble inkjet printhead 10 can be reduced. In the present embodiment, the material of the heaters 120 includes metal oxides (for example, indium-tin oxide, indium-zinc oxide, aluminum tin oxide, aluminum zinc oxide, indium germanium zinc oxide, or other suitable oxides, or stacked layers of at least two of the above). However, the invention is not limited thereto, the material of the heaters 120 may also include metal material (for example, Al, Mo, Au, Cu, Ta, a combination thereof, or an alloy thereof) or polysilicon material.

In the present embodiment, the inkjet chip 100 may further comprise a passivation layer PV. The passivation layer PV is disposed between the ink barrier 200 and the insulating layer IL and covers the heaters 120. The ink barrier 200 is disposed on the passivation layer PV and has a plurality of ink chambers 200*c*. Each of the heaters 120 overlaps one of the ink chambers 200*c* along the normal direction of the substrate 101. The nozzle plate 300 is disposed on the ink barrier 200 and has a plurality of nozzles 300*a*. The nozzles 300*a* respectively overlap the ink chambers 200*c* along the normal direction of the substrate 101. The composition of the ink barrier 200 may include epoxy, polyimide (PI), polyethylene naphthalate (PEN), poly(methyl methacrylate) (PMMA) or siloxane, but the invention is not limited thereto. The composition of the nozzle plate 300 may include epoxy, PI, PEN, PMMA or polycarbonate (PC), but the invention is not limited thereto.

For example, the ink barrier 200 may further comprise a plurality of horizontal ink flow channels (not illustrated). Ink is vertically supplied to these horizontal ink flow channels via an elongated ink slot (not illustrated) which is through the substrate 101 and then enters the corresponding ink chambers 200*c* through theses horizontal ink flow channels. After that, the ink is vaporized by heaters 120 disposed on the substrate 101 and exposed by the ink chambers 200*c* so that the ink is ejected through the nozzles 300*a* on the nozzle plate 300 disposed on the ink chambers 200*c* to form droplets of ink.

In order to enhance the scratch and abrasion resistance properties of the passivation layer PV, the composition of the passivation layer PV may include silicon nitride, silicon carbide, tantalum, a combination thereof, or other abrasion resistant material, but the invention is not limited thereto.

Figure 3:
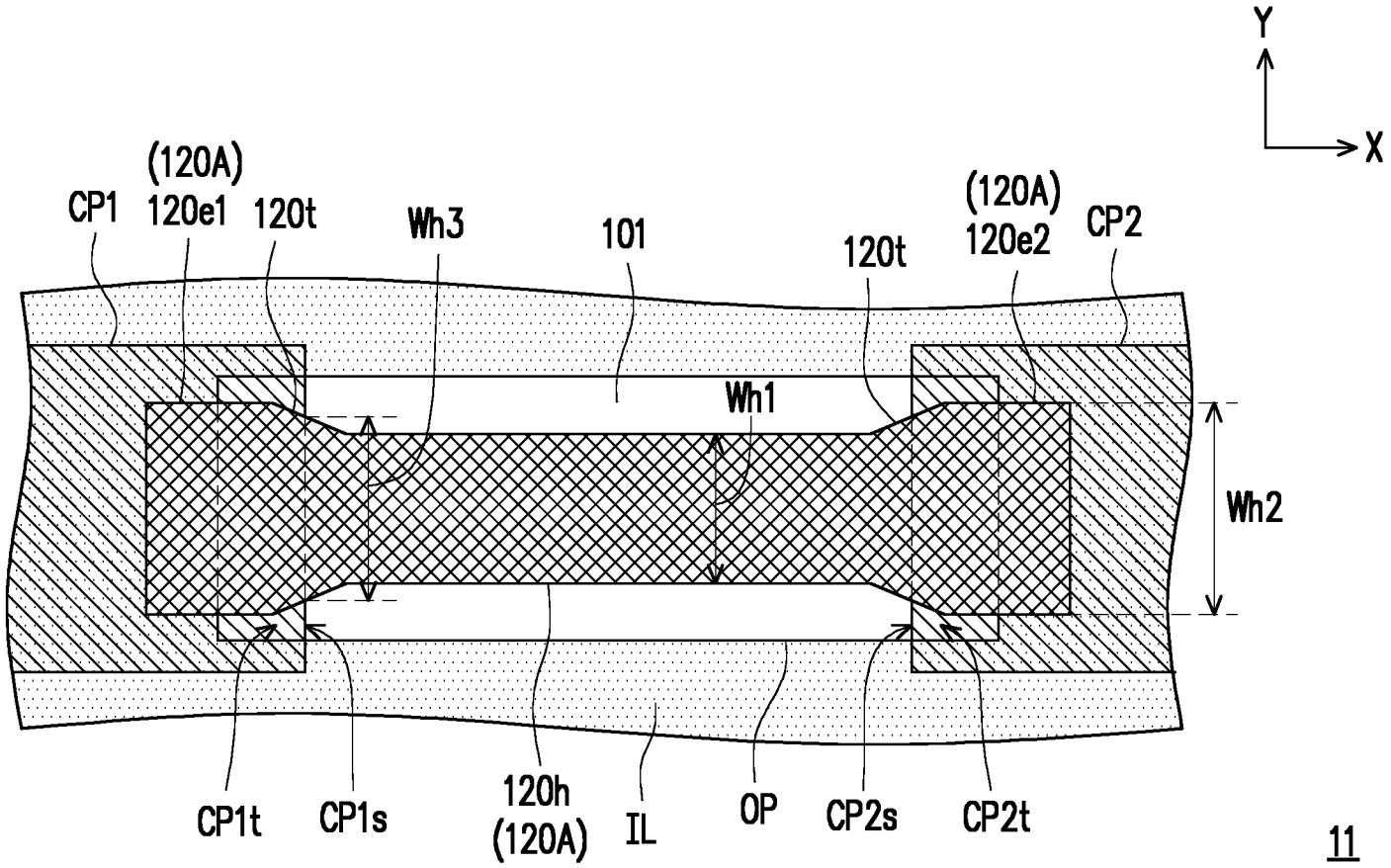
FIG. 3 is a schematic top-view of a thermal bubble inkjet printhead according to a second embodiment of the invention.

FIG. 3 is a schematic top-view of a thermal bubble inkjet printhead according to a second embodiment of the invention. Referring to FIG. 3, the difference between the thermal bubble inkjet printhead 11 of the present embodiment and the thermal bubble inkjet printhead 10 of FIG. 1 lies in the contour of orthogonal projection of the heater on the substrate is different. In the present embodiment, the heaters 120A each include a heating portion 120*h*, a first end portion 120*e*1 and a second end portion 120*e*2. The first end portion 120*e*1 and the second end portion 120*e*2 are located on two opposite sides of the heating portion 120*h* and the heating portion 120*h* is connected between the two end portions.

In detail, the heating portion 120*h* completely overlaps one of the openings OP of the insulating layer IL. Both the first end portion 120*e*1 and the second end portion 120*e*2 partially overlap the one of the openings OP of the insulating layer IL. It is worth noting that, the heating portion 120*h* has a first width Wh1 in the direction Y. The first end portion 120*e*1 and the second end portion 120*e*2 each have a second width Wh2 in the direction Y. The second width Wh2 is greater than the first width Wh1 such that a larger contacting area between the heater 120A and the conductive pattern (i.e., the first conductive pattern CP1 or the second conductive pattern CP2) can be obtained to further improve the current conduction efficiency.

Since the widths of the heating portion 120*h* and the first end portion 120*e*1 (or the second end portion 120*e*2) are different, there exists a transition portion 120*t* between the heating portion 120*h* and each end portion. The width of the transition portion 120*t* in the direction Y decreases from the end portion to the heating portion 120*h*. Specially, a part of the transition portion 120*t* contacting the first sidewall CP of the first conductive pattern CP1 has a width Wh3 in the direction Y. It is worth noting that, the width Wh3 of the transition portion 120*t* is greater than the width Wh1 of the heating portion 120*h* so as to avoid the generation of excess heat while increasing the current conduction efficiency.

Figure 4:
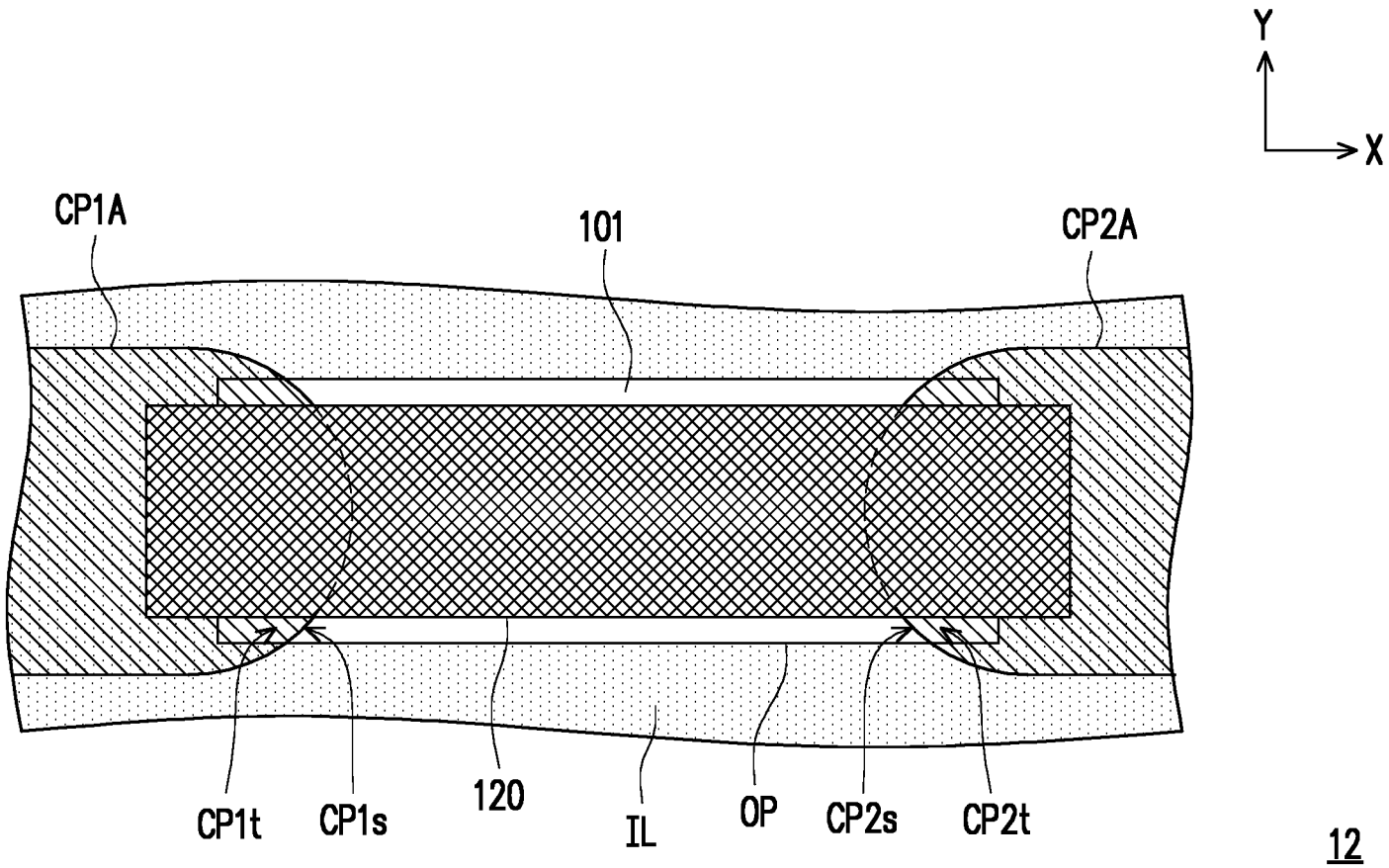
FIG. 4 is a schematic top-view of a thermal bubble inkjet printhead according to a third embodiment of the invention.

FIG. 4 is a schematic top-view of a thermal bubble inkjet printhead according to a third embodiment of the invention. Referring to FIG. 4, the difference between the thermal bubble inkjet printhead 12 of the present embodiment and the thermal bubble inkjet printhead 10 of FIG. 1 lies in the contour of orthogonal projection of the conductive pattern on the substrate is different. In the present embodiment, the orthogonal projections of the first sidewall CP1*s* of the first conductive pattern CP1A and the second sidewall CP2*s* of the second conductive patter CP2A on the substrate 101 are both curves. Specifically, the first sidewall CP1*s* and the second sidewall CP2*s* are convex surfaces toward each other such that the contacting area between the heater 120 and the first sidewall CP1*s* of the first conductive pattern CP1A (or the second sidewall CP2*s* of the second conductive pattern CP2A) can be increased. Accordingly, the current conduction efficiency can be increased and the generation of excess heat can be inhibited.

Figure 5:
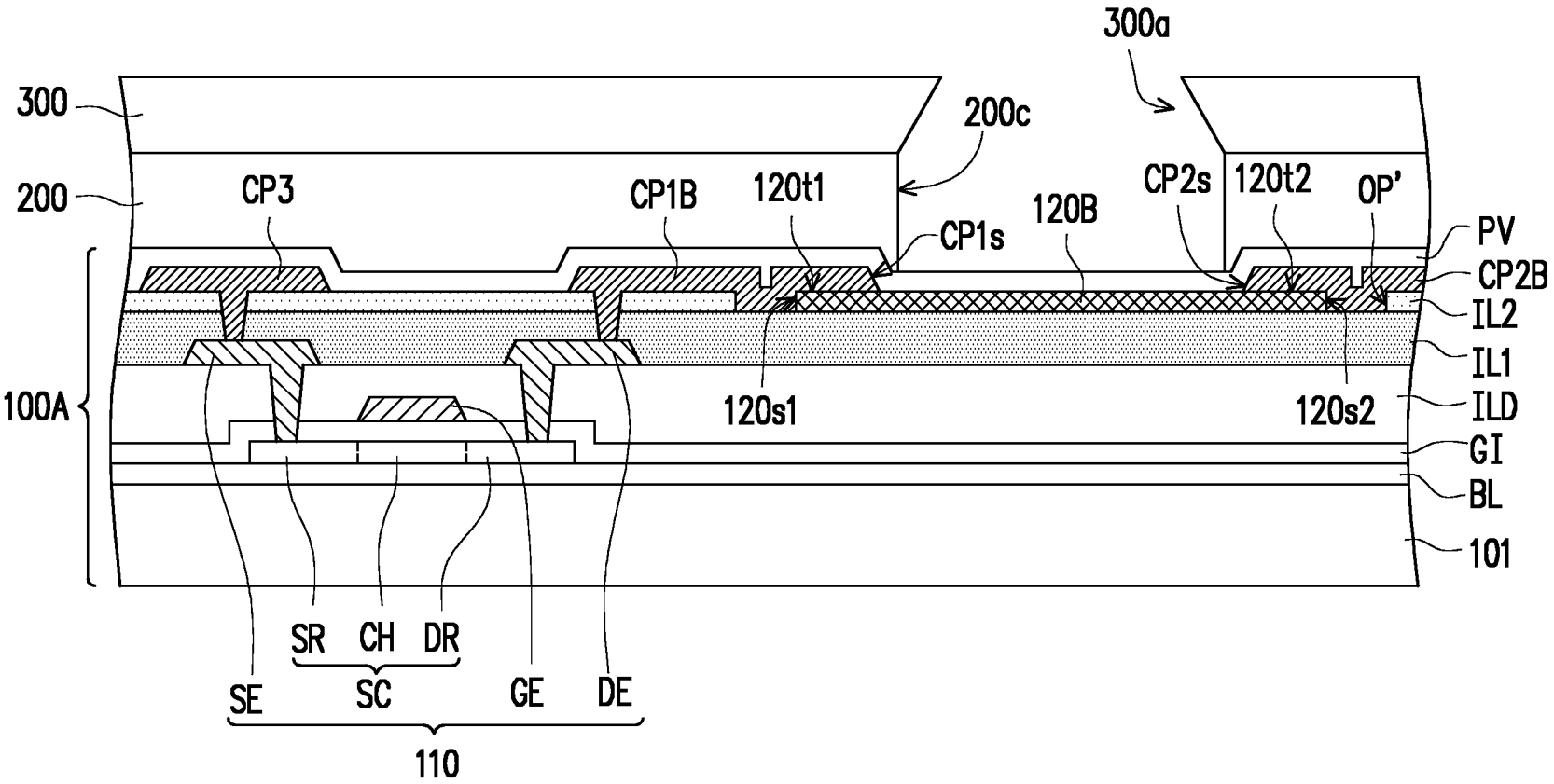
FIG. 5 is a schematic cross-sectional view of a thermal bubble inkjet printhead according to a fourth embodiment of the invention.
Figure 6:
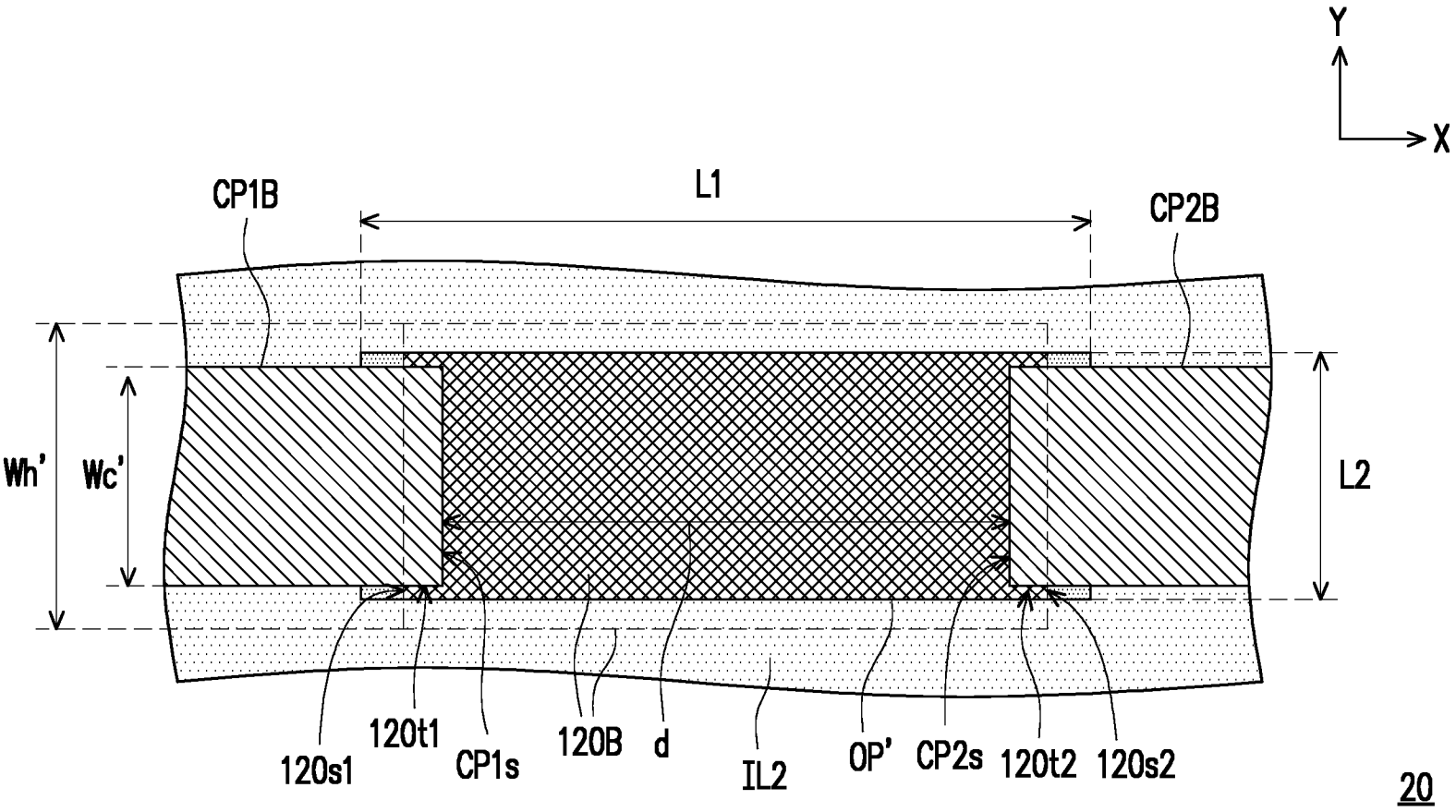
FIG. 6 is a schematic top-view of a thermal bubble inkjet printhead of FIG. 5.

FIG. 5 is a schematic cross-sectional view of a thermal bubble inkjet printhead according to a fourth embodiment of the invention. FIG. 6 is a schematic top-view of a thermal bubble inkjet printhead of FIG. 5. Referring to FIG. 5 and FIG. 6, the difference between the thermal bubble inkjet printhead 20 of the present embodiment and the thermal bubble inkjet printhead 10 of FIG. 1 lies in the configuration of connection between the heater and the conductive pattern is different. In the present embodiment, the inkjet chip 100A further comprises an additional metal conductive layer (for example, a third metal conductive layer). For example, the first conductive patterns CP1B and the second conductive patterns CP2B may belong to the third metal conductive layer. Accordingly, a first insulating layer IL1 and a second insulating layer IL2 are included between the third metal conductive layer and the second metal conductive layer (i.e., the metal conductive layer containing the source electrodes SE and the drain electrodes DE). The first insulating layer IL1 is disposed between the second insulating layer IL2 and the interlayer dielectric layer ILD and covers the source electrodes SE and the drain electrodes DE.

In detail, the heaters 120B is disposed on the first insulating layer ILL The second insulating layer IL2 has a plurality of openings OP' respectively overlapping the heaters 120B. It is worth noting that a part of each heater 120B is exposed by a corresponding opening OP'. For example, the heaters 120B each have a third sidewall 120*s*1, a fourth sidewall 120*s*2, a first surface 120*t*1 and a second surface 120*t*2. The first surface 120*t*1 connects the third sidewall 120*s*1. The second surface 120*t*2 connects the fourth sidewall 120*s*2.

The first conductive pattern CP1B and the second conductive pattern CP2B are disposed on the second insulating layer IL2. The first conductive patterns CP1B penetrates the first insulating layer IL1 and the second insulating layer IL2 to electrically connect the drain electrode DE of one of the control elements 110. That means, each heater 120B is electrically connected to the one of the control elements 110 via one of the first conductive patterns CP1B, but the invention is not limited thereto.

Besides, the third metal conductive layer may further include a plurality of third conductive patterns CP3. Each of the third conductive patterns CP3 penetrates the first insulating layer IL1 and the second insulating layer IL2 to electrically connect the source electrode SE of one of the control elements 110, but the invention is not limited thereto. In the present embodiment, for example, the second conductive patterns CP2B and the third conductive patterns CP3 may be electrically connected to an outer power source to receive driving currents, but the invention is not limited thereto.

It is worth noting that the first conductive pattern CP1B directly contact/cover the third sidewall 120*s*1 and the first surface 120*t*1 to achieve an electrical connection with the heater 120B. Similarly, the second conductive pattern CP2B directly contact/cover the fourth sidewall 120*s*2 and the second surface 120*t*2 to achieve an electrical connection with the heater 120B. In other words, the current is mostly transmitted from the conductive patterns to the heater 120B (or transmitted from the heater 120B to the conductive patterns) through the sidewalls (i.e., the third sidewall 120*s*1 and the fourth sidewall 120*s*2) and surfaces (i.e., the first surface 120*t*1 and the second surface 120*t*2) of the heater 120B exposed by the opening OP' of the second insulating layer IL2. Accordingly, the current conduction efficiency can be enhanced and the generation of excess heat can be effectively inhibited so as to improve the reliability of the thermal bubble inkjet printhead 20.

On the other hand, in the present embodiment, the width Wh' of each heater 120B in the direction Y is greater than the second length L2 of each opening OP' in the direction Y so as to avoid the driving current being transmitted from the conductive pattern to heater (or from the heater to the conductive pattern) through the sidewalls of the heater 120B extending in the direction X (as illustrated in FIG. 6). Accordingly, excess heat generated near the corners of the heater 120B can be effectively inhibited so that the reliability of the thermal bubble inkjet printhead 20 can be improved. In the present embodiment, the width Wc' of the first conductive pattern CP1B (or the second conductive pattern CP2B) is less than the second length L2 of each opening OP', but the invention is not limited thereto. In other embodiments, the width of the first/second conductive pattern in the direction Y may also be greater than the second length L2 of each opening OP'.

In summary, in the inkjet chip and the thermal bubble inkjet printhead according to an embodiment of the disclosure, a sidewall and a surface connected to the sidewall of the heater or the conductive pattern are exposed by an opening of the insulating layer. An electrical connection between the heater and the conductive pattern is carried out through directly covering the sidewall and the surface of one of the heater and the conductive pattern with the other of the heater and the conductive pattern. Accordingly, the current conduction efficiency can be enhanced. Besides, the generation of excess heat can be effectively inhibited so as to improve the reliability of the thermal bubble inkjet printhead.

The foregoing description of the preferred embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Additionally, the abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. It is understood that certain terminology used herein is used for the purpose of describing particular embodiments only and are not intended to be limiting. For example, as used in this specification and the appended claims, the singular forms "a," "an," "at least one," and "the" may include plural referents unless the context clearly dictates otherwise. Any advantages and benefits described may not apply to all embodiments of the invention. It should be appreciated that variations may be made in the embodiments described by persons skilled in the art without departing from the scope of the present invention as defined by the following claims. For example, in the embodiments of the present invention, wherein the heater surrounds the corresponding ink channel in part or entirely, the lead electrically coupled to the heater for conducting current into the heater and the lead electrically coupled to the heater for conducting current out of the heater are not necessary to be arranged adjacent to each other and side by side. Moreover, no element and component in the present disclosure is intended to be dedicated to the public regardless of whether the element or component is explicitly recited in the following claims. These claims may refer to "an" element or "a first" element or the equivalent thereof. Such claims should be understood to include incorporation of one or more such elements, neither requiring nor excluding two or more such elements.

What is claimed is:

1. A thermal bubble inkjet printhead, comprising:

a substrate;

a plurality of control elements, disposed on the substrate;

an insulating layer, disposed on the control elements, the insulating layer has a plurality of openings, and the openings each have a first length in a first direction;

a plurality of first conductive patterns and a plurality of second conductive patterns, separated from each other, the first conductive patterns each have a first sidewall overlapping one of the openings, the second conductive patterns each have a second sidewall overlapping the one of the openings, a distance in the first direction is included between the first sidewall and the second sidewall opposing to each other, and the distance is less than the first length;

a plurality of heaters, electrically connected to the first conductive patterns and the second conductive patterns, wherein each first conductive pattern is electrically connected between one of the control elements and one of the heaters;

an ink barrier, disposed on the heater, the ink barrier has a plurality of ink chambers, each ink chamber overlaps one of the heaters; and a nozzle plate, disposed on the ink barrier, and has a plurality of nozzles, each nozzle overlaps one of the ink chambers.

2. The thermal bubble inkjet printhead as claimed in claim 1, wherein each of the first conductive patterns further has a first surface connecting the first sidewall, each of the second conductive patterns further has a second surface connecting the second sidewall, and the heaters directly cover the first sidewalls, the first surfaces, the second sidewalls and the second surfaces.

3. The thermal bubble inkjet printhead as claimed in claim 1, wherein each of the openings of the insulating layer has a second length in a second direction perpendicular to the first direction, and a width of each of the first conductive patterns and the second conductive patterns in the second direction is greater than the second length of the opening.

4. The thermal bubble inkjet printhead as claimed in claim 1, wherein the control elements are thin film transistors.

5. The thermal bubble inkjet printhead as claimed in claim 1, wherein the composition of the heaters includes a transparent conductive material.

6. The thermal bubble inkjet printhead as claimed in claim 1, further comprising:

a passivation layer, covering the heaters, wherein the ink chambers of the ink barrier expose a part of a surface of the passivation layer, and the material of the passivation layer includes silicon nitride, silicon carbide, tantalum, or a combination thereof.

7. The thermal bubble inkjet printhead as claimed in claim 1, wherein each of the openings of the insulating layer has a second length in a second direction perpendicular to the first direction, and a width of each of the first conductive patterns and the second conductive patterns in the second direction is less than the second length of the opening.

8. The thermal bubble inkjet printhead as claimed in claim 1, wherein each of the heaters includes:

a heating portion, completely overlapping one of the openings of the insulating layer;

a first end portion and a second end portion, located on two opposite sides of the heating portion, the first end portion and the second end portion connect the heating portion and each partially overlap the one opening of the insulating layer, wherein the heating portion has a first width in a second direction perpendicular to the first direction, the first end portion and the second end portion each have a second width in the second direction, and the second width is greater than the first width.

9. The thermal bubble inkjet printhead as claimed in claim 1, wherein each of the heaters includes:

a third sidewall and a fourth sidewall, opposing to each other;

a first surface, connecting the third sidewall; and a second surface, connecting the fourth sidewall, wherein the third sidewall and the first surface are covered with one of the first conductive patterns, and the fourth sidewall and the second surface are covered with one of the second conductive patterns.

10. The thermal bubble inkjet printhead as claimed in claim 1, wherein each of the openings of the insulating layer has a second length in a second direction perpendicular the first direction, and a width in the second direction of each heater is greater than the second length of each opening.

11. An inkjet chip, comprising:

a substrate;

a plurality of control elements, disposed on the substrate;

an insulating layer, disposed on the control elements, the insulating layer has a plurality of openings, and the openings each have a first length in a first direction;

a plurality of first conductive patterns and a plurality of second conductive patterns, separated from each other, the first conductive patterns each have a first sidewall overlapping one of the openings, the second conductive patterns each have a second sidewall overlapping the one of the openings, a distance in the first direction is included between the first sidewall and the second sidewall opposing to each other, and the distance is less than the first length; and a plurality of heaters, electrically connected to the first conductive patterns and the second conductive patterns, wherein each first conductive pattern is electrically connected between one of the control elements and one of the heaters.

12. The inkjet chip as claimed in claim 11, wherein each of the first conductive patterns further has a first surface connecting the first sidewall, each of the second conductive patterns further has a second surface connecting the second sidewall, and the heaters directly cover the first sidewalls, the first surfaces, the second sidewalls and the second surfaces.

13. The inkjet chip as claimed in claim 11, wherein each of the openings of the insulating layer has a second length in a second direction perpendicular to the first direction, and a width of each of the first conductive patterns and the second conductive patterns in the second direction is greater than the second length of the openings.

14. The inkjet chip as claimed in claim 11, wherein the control elements are thin film transistors.

15. The inkjet chip as claimed in claim 11, wherein the composition of the heaters includes a transparent conductive material.

16. The inkjet chip as claimed in claim 11, further comprising:

a passivation layer, covering the heaters, wherein the ink chambers of the ink barrier expose a part of a surface of the passivation layer, and the material of the passivation layer includes silicon nitride, silicon carbide, tantalum, or a combination thereof.

17. The inkjet chip as claimed in claim 11, wherein each of the openings of the insulating layer has a second length in a second direction perpendicular the first direction, and a width in the second direction of each heater is less than the second length of each opening.

18. The inkjet chip as claimed in claim 11, wherein each of the heaters includes:

a heating portion, completely overlapping one of the openings of the insulating layer;

a first end portion and a second end portion, located on two opposite sides of the heating portion, the first end portion and the second end portion connect the heating portion and each partially overlap the one opening of the insulating layer, wherein the heating portion has a first width in a second direction perpendicular to the first direction, the first end portion and the second end portion each have a second width in the second direction, and the second width is greater than the first width.

19. The inkjet chip as claimed in claim 11, wherein each of the heaters includes:

a third sidewall and a fourth sidewall, opposing to each other;

a first surface, connecting the third sidewall; and a second surface, connecting the fourth sidewall, wherein the third sidewall and the first surface are covered with one of the first conductive patterns, and the fourth sidewall and the second surface are covered with one of the second conductive patterns.

20. The inkjet chip as claimed in claim 11, wherein each of the openings of the insulating layer has a second length in a second direction perpendicular the first direction, and a width in the second direction of each heater is greater than the second length of each opening.

* * * * *